US006993828B2

(12) United States Patent
Ha et al.

(10) Patent No.: US 6,993,828 B2
(45) Date of Patent: Feb. 7, 2006

(54) METHOD FOR MANUFACTURING METAL THIN FILM RESISTOR

(75) Inventors: Jo-Woong Ha, Seoul (KR); Seung-Hyun Kim, Seoul (KR); Dong-Yeon Park, Seoul (KR); Dong-Su Lee, Gwacheon-si (KR); Hyun-Jung Woo, Anyang-si (KR)

(73) Assignee: Inostek Inc., (KR)

( * ) Notice: Subject to any disclaimer, the term of this patent is extended or adjusted under 35 U.S.C. 154(b) by 74 days.

(21) Appl. No.: 10/468,725

(22) PCT Filed: Feb. 22, 2002

(86) PCT No.: PCT/KR02/00287

§ 371 (c)(1),
(2), (4) Date: Aug. 21, 2003

(87) PCT Pub. No.: WO02/069355

PCT Pub. Date: Sep. 6, 2002

(65) Prior Publication Data

US 2004/0085183 A1 May 6, 2004

(30) Foreign Application Priority Data

Feb. 24, 2001 (KR) ..... 2001-9524

(51) Int. Cl.
*H01C 17/06* (2006.01)

(52) U.S. Cl. ..... 29/620; 29/610.1; 29/621; 29/621.1; 257/741; 257/763; 257/E21.006; 338/309; 438/571

(58) Field of Classification Search ..... 29/620, 29/610.1, 621, 621.1; 338/309; 257/741, 257/763, E21.006; 438/571
See application file for complete search history.

(56) References Cited

U.S. PATENT DOCUMENTS

| | | | | |
|---|---|---|---|---|
| 4,907,066 A * | 3/1990 | Thomas et al. | ..... | 257/741 |
| 5,569,614 A * | 10/1996 | Kataoka et al. | ..... | 438/571 |
| 6,731,007 B1 * | 5/2004 | Saito et al. | ..... | 257/762 |

FOREIGN PATENT DOCUMENTS

| | | |
|---|---|---|
| JP | 2000-111937 | 4/2000 |
| KR | 1993-17153 | 8/1993 |
| KR | 1996-11482 B1 | 8/1996 |

OTHER PUBLICATIONS

PCT International Search Report; International application No. PCT/KR02/00287; International filing date: Feb. 22, 2002; Mailing date of : Jun. 12, 2002.

* cited by examiner

*Primary Examiner*—A. Dexter Tugbang
*Assistant Examiner*—Tim Phan
(74) *Attorney, Agent, or Firm*—Cantor Colburn LLP

(57) ABSTRACT

A metal resistor and a method for manufacturing the resistor are provided. A first insulation film is formed on a substrate, a photosensitive film is applied on the insulation film, and an insulation film pattern is formed by patterning the insulation film. After a metal thin film is formed among the insulation film pattern and on the photosensitive film, with removing the photo-sensitive film is a metal thin film pattern formed among the insulation film pattern. On the metal thin film pattern and the insulation film pattern is a second insulation film formed and at the pad region of the metal thin film pattern is a lead wire connected, after that, a metal thin film resistor is manufactured with forming a preservation film on and around the lead wire. Using a pattern-forming process by etching of the insulation film for forming the metal thin film pattern, the deterioration of the device or the lowering of the durability can be overcome, the resistance of the metal thin film resistor can be easily controlled, and the resolving power can be improved by producing the high-resistance metal thin film temperature having reduced line with of the metal thin film pattern.

6 Claims, 5 Drawing Sheets

METHOD FOR MANUFACTURING METAL THIN FILM RESISTOR

CROSS REFERENCE TO RELATED APPLICATION

This application is the U.S. National Phase under 35 U.S.C. 371 of International Application PCT/KR02/00287, filed Feb. 22, 2002, which claims priority to Korean Patent Application No. 2001-0009524, filed Feb. 24, 2001.

1. Technical Field

The present invention relates to a resistor device using a metal thin film and a method for manufacturing the resistor device, and more particularly relates to a metal thin film resistor device formed on a having a minimized size as well as an improved durability since a metal thin film is buried in an etched insulation layer.

2. Background of the Invention

In general, a metal such as platinum (Pt), nickel (Ni) and tungsten (W) has a resistance varied in accordance with temperature, thereby being utilized as a thermosensor using temperature-resistance behavior of above metal.

In relation to the thermosensor, thermosensor devices using a metal thin film for response time or device-miniaturization are on the market. The metal thin film thermosensor already on the market is produced using an alumina substrate considering a problem, for example, adhesion strength of the metal thin film thermosensor to the substrate. That is, after predetermined metal thin film is deposited on the alumina substrate, metal thin film is patterned through the process of a laser trimming method, a wet etching method or a dry etching method such as a plasma etching etc, to have a desired resistance.

FIG. 1*a* to FIG. 1*c* are sectional views for illustrating a method for manufacturing the conventional thin film-type metal resistor device.

Referring to FIG. 1*a*, a metal thin film 15 is primarily deposited on an insulation substrate 10. In this case, only insulation material such as alumina can be used as a substrate 10 and the metal thin film 15 consists of platinum, nickel, copper or tungsten according to the conventional method.

Then, to have the desired resistance in view of the metal thin film 15, a photosensitive film 20 is coated on the metal thin film 15, and the metal thin film 15 is patterned by the wet etching method or the dry etching method for using the photosensitive film 20 as a mask.

When the metal thin film 15 is etched by using the laser trimming method, an additional photosensitive film need not be formed on the metal thin film 15 but some problems such as the deterioration of the metal thin film and the lowering of the yield may occur.

Referring to FIG. 1*b*, after forming metal thin film patterns 25 are formed by patterning the metal thin film 15 and removing the photosensitive film 20, an insulation layer 30 is formed on the whole surface of the substrate 10 on which the metal thin film patterns 25 are formed. At that time, the metal thin film patterns 25 may be separated from the substrate 10 or the insulation layer 30 may not uniformly attached to the metal thin film patterns 25 because being protruded from the surface of the substrate 10, the metal thin film patterns 25 are exposed.

Referring to FIG. 1*c*, after removing portions of the insulation layer 30 positioned on a pad region of the metal thin film patterns 25, a lead wire 35 is attached to the pad region of the metal thin film layer 25 so as to connect the device to an outer circuit. Subsequently, in order to protect a portion where the lead wire 35 is connected, a passivation layer 40 is coated on the lead wire 35 and on the insulation layer 30, thereby accomplishing the thin film-type metal resistor device.

However, when the alumina substrate is used, the surface treatment process of the alumina substrate should be necessary for adjusting precisely a roughness of the surface of the alumina substrate because the metal thin film deposited on the alumina substrate has a thickness of approximately several micrometers. The surface treatment process is too expensive, and yet additional processes may be necessary so as to increase the adhesion strength of the metal thin film formed on the substrate, such as the treatment of a corona discharging on the surface of the alumina substrate.

Also, when the metal thin film is patterned by the laser trimming method, the problem of a deterioration of the metal film and a lowering of the yield, etc may occur due to a laser processing. In case of the wet-etching process for patterning the metal thin film with the photosensitive film, it is difficult to control an etching rate of the metal thin film because a concentration of an etching solution is varied with the degree of the wet-etching.

Also, line widths of the patterns may be limited in accordance with the etching rate or an etched shape of the metal thin film. In this case, after forming the patterns, a resistance of the metal thin film can be controlled by the a variable resistor which is made when a mask pattern is manufactured.

Moreover, when the patterns are formed using the dry etching method, the metal thin film patterns may be accurately formed. However, the patterns may not have precise sizes because etched metal thin film patterns may stick to an etching surface according to the kinds of metals, therefore an expensive equipment should be required for the patterns to have precise sizes.

Disclosure of the Invention

Therefore, it is an object of the present invention to provide a metal thin film resistor device that can easily control a resistance of the resistor device, can increase a durability of the resistor device and can minimize the size of the resistor device because the metal thin film resistor device is manufactured by depositing a metal thin film on desired insulation film patterns after the insulation film patterns are previously formed by etching an insulation film.

It is another object of the present invention to provide a method for manufacturing a metal thin film resistor device having an easily controlled resistance, an improved durability and a minimized size.

To achieve the above mentioned object of the present invention, there is provided a metal thin film resistor device having insulation film patterns formed on a substrate, metal thin film patterns formed within the insulation film patterns, a lead wire attached to a pad region of the metal thin film patterns, an insulation film formed on the metal thin film patterns and on the insulation film patterns, and a passivation layer formed on the lead wire and a peripheral portion of the lead wire.

Preferably, the metal thin film patterns are formed from at least one selected from the group consisting of platinum (Pt), nickel (Ni), copper (Cu), tungsten (W), tantalum (Ta), aluminum (Al), palladium (Pd), rhodium (Rh), iridium (Ir) and tantal-aluminum (TaAl).

To achieve another object of the present invention, according to one preferred embodiment of the present invention, there is provided a method for manufacturing a metal thin film resistor device, which comprises the steps of forming a first insulation film on an insulation substrate, patterning the first insulation film to form insulation film patterns, forming metal thin film patterns within the insulation film patterns, attaching a lead wire to a pad region of the metal thin film patterns, forming a second insulation film on the metal thin film patterns and on the insulation film patterns, and forming a passivation layer on the lead wire and on a peripheral portion of the lead wire. In this case, the step of forming the first insulation film is performed by a thermal oxidation method, the step of patterning the first insulation film further has the step of coating a photosensitive film on the first insulation film, and the step of forming the metal thin film patterns is performed after forming a metal thin film within the insulation film patterns and on the photosensitive film.

Preferably, the step of forming the metal thin film is performed by a DC/RF sputtering method, a metal organic chemical vapor deposition method, a vacuum evaporation method, a laser deposition(laser ablation) method, a partially ionized beam deposition method or an electroplating method.

Also, to achieve another object of the present invention, according to another preferred embodiment of the present invention, there is provided a method for manufacturing a metal thin film thermosensor, which comprises the steps of patterning a silicon substrate or a metal substrate to form patterns on the substrate, forming insulation film patterns on the substrate using the patterns, forming a metal thin film within the insulation film patterns and on the insulation film patterns, removing the metal thin film on the insulation film patterns, forming metal thin film patterns within the insulation film patterns, connecting a lead wire to the metal thin film patterns, forming an insulation film on the metal thin film patterns and on the insulation film patterns, and forming a passivation layer on the lead wire and on a peripheral portion of the lead wire.

Preferably, the insulation film patterns are formed on the substrate by heating, and the metal thin film on the insulation film patterns is removed by chemical mechanical polishing (CMP) method.

According to the present invention, the metal thin film patterns are formed by etching the insulation film during the process for manufacturing the metal thin film resistor device, thereby resolving some problems such as the deterioration of the device, the decrease of the durability of the device, and the minimization of the device. Considering the present technology, the metal thin film patterns formed within the insulation film patterns can have line widths of about 0.1 $\mu$m because the insulation film patterns formed on the substrate have widths of about 0.1 $\mu$m and the metal thin film patterns are formed within the insulation film patterns.

Also, because the process of forming the patterns in the insulation film is easily performed to control the line widths and the accurate dimensions of the patterns in comparison with that of forming the patterns in a metal film, the resistance of the metal thin film resistor device can be easily controlled when the metal thin film patterns are formed within the insulation film patterns, and a temperature resolution can be enhanced by means of fabricating the thermosensor having a high resistance according as the line widths of the metal thin film patterns are reduced.

Also, a test wafer for compensating temperature according to the present invention can precisely measure a surface temperature of a substrate, so the test wafer can improve the process for depositing the film. The metal thin film resistor device of the present invention can also be used as a thin film heater. Furthermore, the construction of the metal thin film resistor device according to the present invention can be applied to electric devices using the oxide film, and allow the metal thin film resistor device to be manufactured more easily and cheaply since it does not depend on the kind of a substrate nor a deposition process.

In the present invention, a resistance of a metal applied to the metal thin film resistor device can be expressed by the following Equation 1.

$$R=p\times(L/A) \quad \text{[Equation 1]}$$

wherein R represents the resistance of the metal (Ω), p means a specific resistance (Ω·cm), L indicates a length of the metal thin film resistor, and A is an (cross sectional) area of the metal thin film resistor device.

Also, the resistance of the metal depends on variables in the above equation 1 and on other variable such as temperature. For example, the resistance of a metal, such as platinum, nickel, copper or tungsten, etc., characteristically increases linearly in proportion to temperature. Using this characteristic of the metal whose resistance increases in proportion to temperature, the metal thin film resistor device is used as a thermosensor for measuring peripheral temperature.

A metal thermosensor usually has a resistance at a specific temperature expressed by the following Equation 2.

$$R(T)=R_0+\alpha\times T\times R_0 \quad \text{[Equation 2]}$$

In the above Equation 2, R (T) represents the resistance at the specific temperature T, $R_0$ is the resistance at a reference temperature (for example, 0° C.), a means a temperature coefficient of resistance, and T is a measured temperature.

Temperature coefficients of resistance (α) of materials are respectively determined. Also, the resistance variation of the metal increases corresponding to the temperature variation when the resistance of the metal increases according to the above Equation 1, thereby precisely measuring temperature with the above Equation 2. In general, since a tendency of the device to become lighter, thinner, shorter and smaller, it is a contemporary tendency that micro-devices having small sizes and qualified dimensions are in demand. Therefore, the metal thin film thermosensors manufactured with a thin film technology are widely known and some products are being used on the market.

A minimum thickness of a metal is determined in accordance with the kinds of metals to obtain its bulk characteristic and a metal does not show the bulk characteristic if the metal has a thickness below a specific thickness. Hence, the metal thin film should have a thickness above the specific thickness in order to obtain a device having stable properties. For example, it is known that a resistor device manufactured using platinum should have a thickness above approximately 1.2 $\mu$m.

When a metal thin film has a constant thickness, the resistance of the metal thin film varies by means of a line width of a metal thin film pattern. To control the line width of the metal thin film pattern, the laser trimming method, the wet etching method or the dry etching method is utilized in accordance with the conventional method for manufacturing the metal thin film. However, a deposited metal thin film should be etched according to the conventional method, so the line width of the metal thin film pattern cannot be precisely controlled as well as the device including the metal thin film pattern may be deteriorated.

According to the present invention, metal thin film patterns are formed by means of depositing a metal thin film within insulation film patterns after an insulation film on a substrate is etched to from the insulation film patterns without etching the metal thin film. Thus, the method of the present invention has some advantages as follows.

A substrate consisting of metal as well as silicon can be sufficiently used besides alumina for manufacturing the metal thin film patterns. Also, the insulation film can be patterned to form the insulation film patterns having line widths of approximately 0.1 $\mu$m and the metal thin film patterns formed within the insulation film patterns can have line widths of approximately 0.1 $\mu$m, whereby minimizing a size of a metal thin film resistor device including the metal thin film patterns. Therefore, a thermal conductivity of the substrate and a response characteristic of a thermosensor are improved when the metal thin film resistor device is used as the thermosensor.

Generally, because a silicon substrate or a metal substrate has a thermal conductivity higher than that of a ceramic substrate, they can improve the response characteristic of the device formed on the substrate. In addition, the etching process for the insulation film can be more precisely performed in comparison with the metal thin film, thereby improving the control of the line widths of the metal thin film patterns within the insulation film patterns and enhancing the uniformities of the metal thin film patterns. In particular, a thermal oxidation film can be used as the insulation film when the substrate is a silicon wafer. In this case, the size of the device can be greatly minimized because the line widths of the metal thin film patterns can be reduced to sub-micron units by a photolithography process used in a semiconductor technology. Also, the thermosensor can be positioned in a semiconductor chip when the silicon substrate is used so that a thermal effect, reported as a main reason causing a malfunction of the semiconductor chip under hot conditions, can be resolved by designing a compensating circuit corresponding to temperature. Furthermore, the durability of the device can be improved by preventing the device from separating from the substrate during subsequent processes because the metal thin film is deposited on insides of the etched surfaces of the insulation film patterns.

BRIEF DESCRIPTION OF THE DRAWINGS

The above objects and other advantages of the present invention will become more apparent by describing in detail preferred embodiments thereof with reference to the attached drawings in which.

BEST MODES FOR CARRYING OUT THE INVENTION

Hereinafter, a metal thin film resistor device and a method for manufacturing the metal thin film resistor device according to the present invention will be explained with reference to the accompanying drawings, however, it is understood that the present invention should not be limited to the following device and method set forth herein.

Figure 1A:
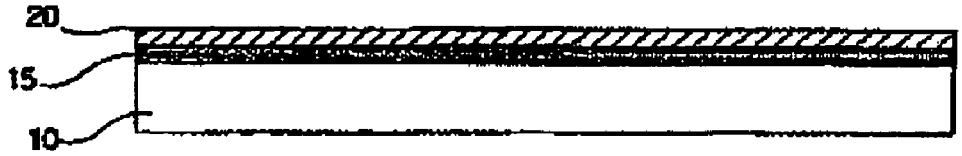
FIG. 1A (PRIOR ART)
FIG. 1*a* to FIG. 1*c* are sectional views for illustrating a method for manufacturing the conventional film-type metal resistor.
Figure 1B:
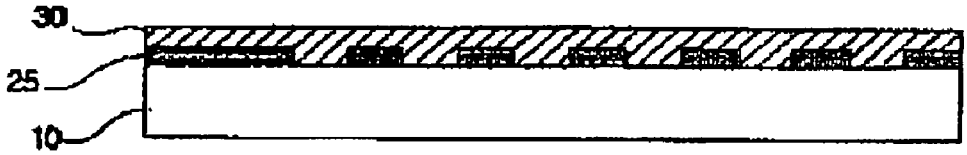
FIG. 1B (PRIOR ART)
Figure 1C:
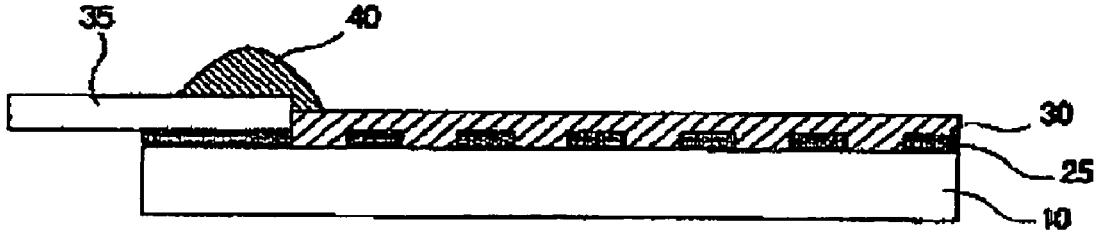
FIG. 1C (PRIOR ART)
Figure 2:
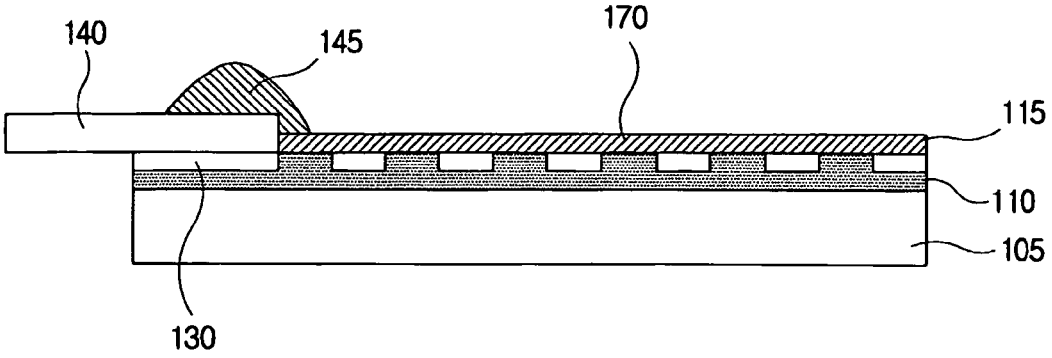
FIG. 2 is a sectional view for showing a metal thin film resistor device according to the present invention.

FIG. 2 is a sectional view of a metal thin film resistor device according to the present invention.

Referring to FIG. 2, a metal thin film resistor 100 device of the present invention has a substrate 105, insulation film patterns 110 formed on the substrate 105, metal thin film patterns 115 buried within the insulation film patterns 110, a lead wire 140 attached to a pad region of the metal thin film patterns 115, an insulation film 170 formed on the metal thin film patterns 115 and on the insulation film patterns 110, and a passivation layer 145 formed on the lead wire 140 and the insulation film 170.

When the substrate 105 corresponds to a silicon substrate, a silicon oxide ($SiO_2$) film having predetermined thickness is coated on the silicon substrate by a thermal oxidation method or a chemical vapor deposition (CVD) method to form the insulation film patterns 110. In addition, the substrate 105 can be a semiconductor substrate composed of a single component such as silicon (Si), germanium (Ge) or diamond (C), or the substrate 105 may be a compound semiconductor substrate composed of one from the group consisting of gallium-arsenic (Ga—As), indium phosphate (InP), silicon-germanium (Si—Ge) and silicon carbide (SiC). Moreover, the substrate 105 can be a single crystalline ceramic substrate or a poly crystalline ceramic substrate. At that time, the single crystalline ceramic substrate is composed of one selected from the group consisting of $SrTiO_3$, $LaAlO_3$, $Al_2O_3$, KBr, NaCl, $ZrO_2$, $Si_3N_4$, $TiO_2$, $Ta_2O_5$ and AlN, and the poly crystalline ceramic substrate is composed of one selected from the group consisting of Si, $SrTiO_3$, $LaAl_3$, MgO, KBr, NaCl, $Al_2O_3$, $ZrO_2$, $Si_3N_4$, $TiO_2$, $Ta_2O_5$ and AlN.

The silicon oxide film is a compound in which silicon of the substrate 105 reacts with oxygen so that the silicon oxide film chemically bonds to the substrate 105. The insulation film patterns 110 are formed on the silicon oxide film by the photolithography process. A photosensitive film for forming the insulation film patterns 110 is removed after a metal thin film is coated on the photosensitive film. The metal thin film is deposited by a direct current/radio frequency (DC/RF) magnetron sputtering method, a DC/RF sputtering method, a metal organic chemical vapor deposition method, a vacuum evaporation method, a laser ablation method, a partially ionized beam deposition method or an electroplating method. The metal thin film is composed of at least one selected from the group consisting of platinum (Pt), nickel (Ni), copper (Cu), tungsten (W), tantalum (Ta), aluminum (Al), palladium (Pd), rhodium (Rh), iridium (Ir) and tantal-aluminum(Ta—Al).

When the metal thin film is composed of platinum, the metal thin film is formed using a platinum target having a purity of above 99.995% at a room temperature and under a deposition pressure of about 1~10 mTorr with a deposition power of about 150 W. In this case, the platinum target has a size of about 4 inches and the metal thin film composed of platinum is subsequently heated for about 1 hour at a temperature of about 1000° C. in air after the metal thin film is deposited.

When the photosensitive film is removed after the metal thin film is deposited, the desired metal thin film patterns 115 are formed on portions where the thermal oxidation film is etched. After the metal thin film patterns 115 are formed, the lead wire 140 is attached to the pad region of the metal thin film patterns 115 in order to connect a metal thin film resistor device to an outer circuit. Then, the metal thin film resistor device is completed after the passivation layer 145 is coated on the lead wire 140.

Hereinafter, the method for manufacturing the metal thin film resistor device of the present invention will be explained with reference to the accompanying drawings.

FIG. 3*a* to FIG. 3*e* are sectional views for illustrating the method for manufacturing the metal thin film resistor device in FIG. 2. In FIG. 3*a* to FIG. 3*e*, the same reference numerals are used for the same elements in FIG. 2.

Figure 3A:
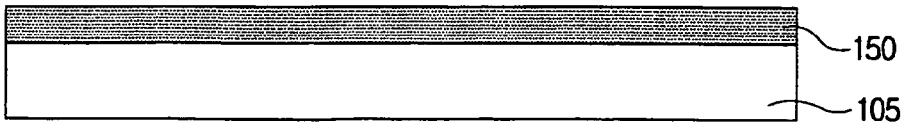
FIG. 3*a* to FIG. 3*e* are sectional views for illustrating a method for manufacturing the metal thin film resistor device in FIG. 2.
Figure 3B:
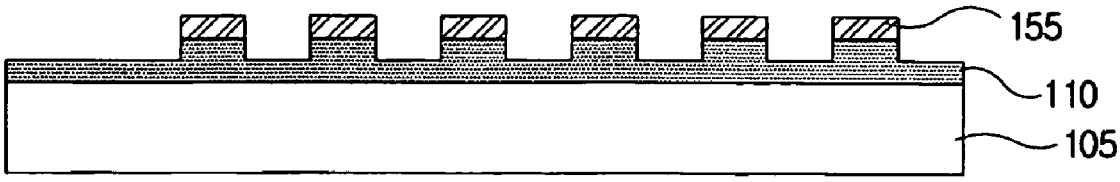

Referring FIG. 3*a*, at first, a first insulation film 150 is formed on a substrate 105 corresponding to a silicon wafer or a metal substrate by a thermal oxidation method or a chemical vapor deposition method. In this case, the first insulation film 150 on the substrate 105 is coated to have a thickness of about 1~5 $\mu$m, and the metal substrate 105 is composed of one selected from the group consisting of gold (Au), silver (Ag), aluminum (Al), iridium (Ir), platinum (Pt), copper (Cu), palladium (Pd), ruthenium (Ru), tungsten (W) and tantal-aluminum(Ta—Al). Also, the first insulation film 150 is composed of amorphous material or glass material selected from the group of consisting of BSG, PSG, BPSG, $SiO_2$ and $TiO_2$Referring to FIG. 3*b*, after a photosensitive film 155 is coated on the first insulation film 150, insulation film patterns 110 are formed on the substrate 105 through an etching process using the photosensitive film 155 as a mask. The insulation film patterns 110 are formed to have line widths of approximately 0.1~2.0 $\mu$m.

When the first insulation film 150 is the thermal oxidation film formed on the silicon substrate 105, the first insulation film 150 is etched with a buffered oxide etchant (BOE) as an etching solution generally used during the etching in semiconductor technology. At that time, the insulation film patterns 110 can be formed using a negative photosensitive film or a positive photosensitive film as the photosensitive film 155 for etching the first insulation film 150.

As it is described above, though the insulation film patterns 110 are formed on the substrate 105 when the substrate 105 is composed of silicon or metal, the insulation film patterns 110 may not be formed on the substrate 105 when the substrate 105 is composed of an insulator such as glass or ceramic. At that time, a single crystalline ceramic substrate composed of one selected from the group consisting of $SrTiO_3$, $LaAlO_3$, $Al_2O_3$, KBr, NaCl, $ZrO_2$, $Si_3N_4$, $TiO_2$, $Ta_2O_5$ and AlN may be used, or a poly crystalline ceramic substrate composed of one selected from the group consisting of Si, $SrTiO_3$, $LaAlO_3$, MgO, KBr, NaCl, $Al_2O_3$, $ZrO_2$, $Si_3N_4$, $TiO_2$, $Ta_2O_5$ and AlN may be used as the substrate 105.

Figure 3C:
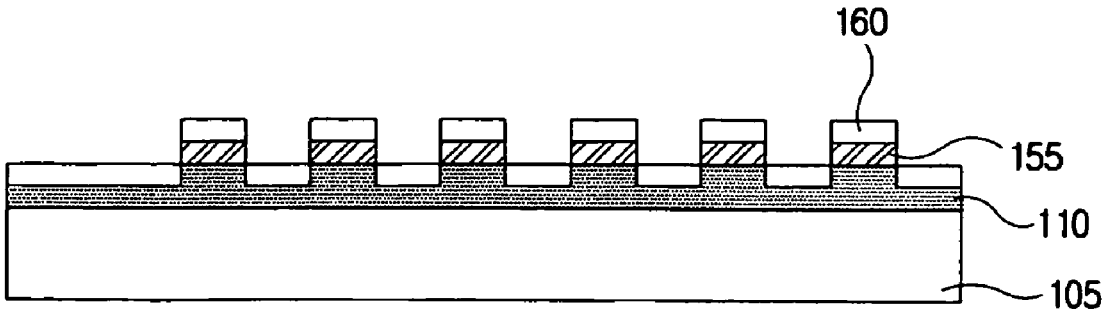

Referring to FIG. 3*c*, when the photosensitive film 155 is positioned on the insulation film patterns 110, a metal thin film 160 is deposited within the insulation film patterns 110 and on the photosensitive film 155 to have a thickness of about 0.5~1.5 $\mu$m by a sputtering method, a metal organic chemical vapor deposition method, a vacuum evaporation method, a laser ablation method, a partially ionized beam deposition method or an electroplating method. In this case, the metal thin film 160 is composed of at least one selected from the group consisting of platinum (Pt), nickel (Ni), copper (Cu), tungsten (W), tantalum (Ta), aluminum (Al), palladium (Pd), rhodium (Rh) and iridium (Ir). Preferably, the metal thin film 160 is formed using platinum by the sputtering method. At that time, the metal thin film 160 composed of platinum is deposited using a platinum target having a purity of above 99.995% and a size of about 4 inches at a room temperature under a deposition pressure of about 1~10 mTorr with a deposition power of about 150 W. After the platinum thin film is formed, the platinum thin film is heated for about 1 hour at a temperature of 1000° C. in air.

While the metal thin film 160 has a thickness of about 0.5~1.5 $\mu$m, the first insulation film 150 has a thickness of about 1~5 $\mu$m. Hence, the thickness of the insulation film pattern 110 is thicker than that of a metal thin film pattern 115 subsequently formed.

Figure 3D:
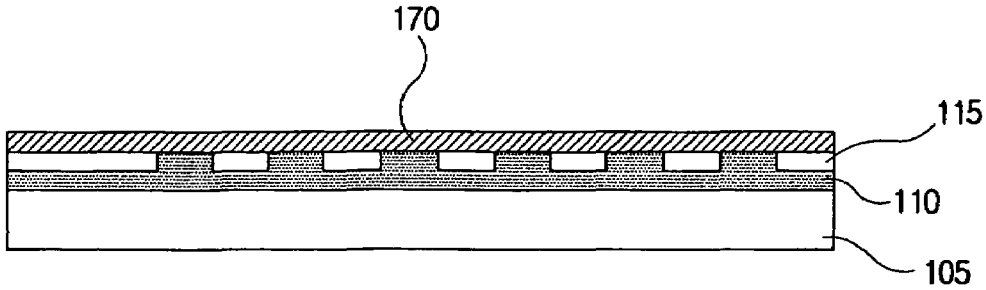

Referring to FIG. 3*d*, the photosensitive film 155 is removed using an organic solution like acetone to form metal thin film patterns 115 positioned within the insulation film patterns 110. More particularly, when the photosensitive film 155 is removed, the metal thin film 160 on the photosensitive film 155 is also removed with the photosensitive film 155. Thus, the metal thin film patterns 115 remain within the insulation film patterns 110.

Subsequently, a second insulation film 170 is formed on the metal thin film patterns 115 and on the insulation film patterns 110. The second insulation film 170 is composed of amorphous or glass material selected from the group consisting of BSG, PSG, BPSG, $SiO_2$ and $TiO_2$.

In case that the metal thin film resistor device is manufactured in accordance with the method of the present invention, an additional patterning process for patterning the metal thin film is not demanded. Also, the insulation film patterns 110 can have the line widths of sub-micro meter to approximately 0.1 $\mu$m through patterning the first insulation film 150 such as the thermal oxidation film formed on the silicon substrate 105 using the conventional semiconductor technology. Therefore the metal thin film patterns 115 also have the line widths identical to those of the insulation film patterns 110.

In addition, since the metal thin film patterns 115 only exist within the insulation film patterns 110 on the substrate 105, the metal thin film patterns 115 can be separated from the substrate 105 during subsequent processes compared with the conventional method, thereby improving a durability of the metal thin film resistor device.

Figure 3E:
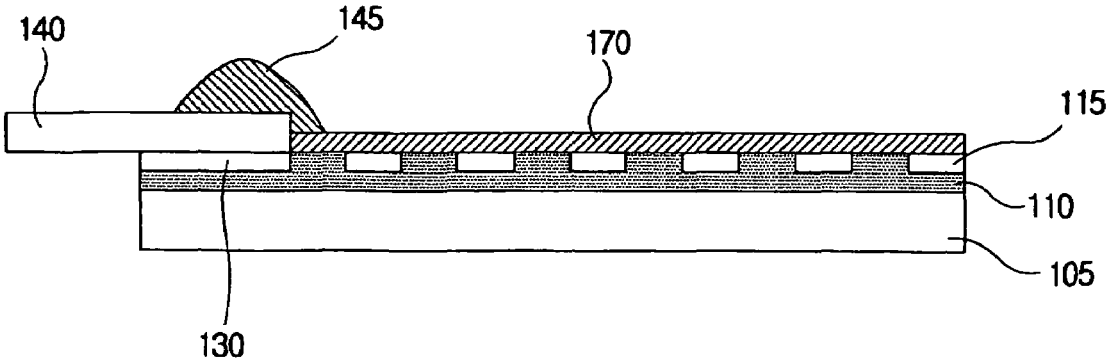

Referring to FIG. 3*e*, after a portion of the second insulation film 170 positioned on a pad region 130 of the metal thin film patterns 114 is removed, a lead wire 140 is attached to the pad region 130 of the metal thin film patterns 115 for electrical connection the pad region 130 to an outer circuit.

Then, a passivation layer 145 is coated on the lead wire 140 and on a portion of the second insulation film 170. The passivation layer 145 is composed of PSG, BSG, BPSG or organic insulation material. Therefore, a metal thin film resistor device 100 is completed.

Hereinafter, various embodiments of the present invention will be explained in more detail, however, it is understood that the present invention should not be restricted or limited to the following embodiments set forth herein.

Embodiment 1

At first, after a thermal oxidation film corresponding to a first insulation film was formed on a substrate such as a silicon wafer to have a thickness of about 2.5 $\mu$m by the thermal oxidation method, a photosensitive film was coated on the thermal oxidation film. Then, the thermal oxidation film was patterned by the photolithography process to form insulation film patterns having line width of about 0.1~2 $\mu$m. The insulation film pattern on the substrate has a thickness of about 1.5 $\mu$m. When the thermal oxidation film was patterned, a BOE solution was used as an etchant widly used in semiconductor technology.

Platinum was sputtered to from a platinum thin film having a thickness of about 1.0 $\mu$m while the photosensitive film was coated on the insulation film patterns. The platinum thin film was formed using a platinum target having a purity of above 99.995% and a size of about 4 inched at a room temperature under a deposition pressure of about 1~10 mTorr with a deposition power of about 150 W. After the platinum thin film is coated, the platinum thin film was subsequently heated for about 1 hour at a temperature of about 1000° C.

After the platinum thin film was formed, platinum thin film patterns were formed within the insulation film patterns by means of removing the photosensitive film with an organic solution including acetone. A second insulation film was formed on the platinum thin film patterns and on the insulation film patterns, and then a lead wire was connected to a pad region of the platinum thin film patterns and a passivation layer was formed on the lead wire and on the second insulation film, thereby completing a platinum thin film thermosensor.

Figure 4:
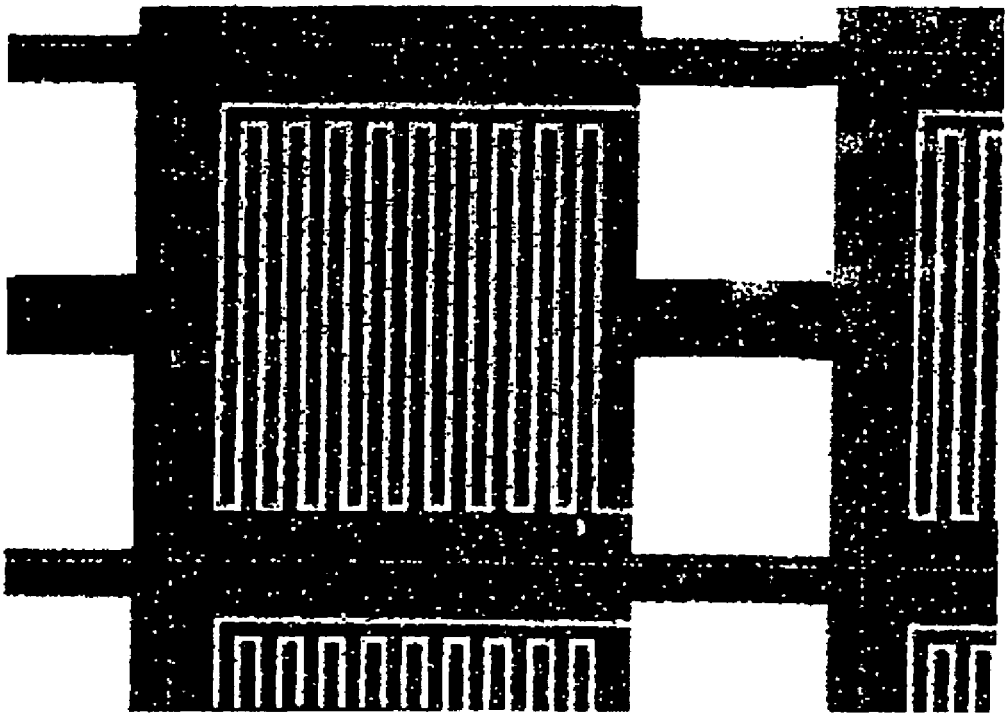
FIG. 4 is an optical microscope picture of a thin film thermosensor composed of platinum according to a preferred embodiment of the present invention.

FIG. 4 is an optical microscope picture of the platinum thin film thermosensor according to the present embodiment. As shown in FIG. 4, the platinum thin film having a desired line width is uniformly formed within the insulation film patterns.

Hence, the modulation of line width and the durability of the metal thin film resistor device can be improved through the platinum thin film thermosensor of the present embodiment.

Embodiment 2

A test wafer for compensating temperature used in semiconductor manufacturing process was manufactured according to the present embodiment.

At first, after an oxide film corresponding to a first insulation film was formed on a substrate such as a silicon wafer to have a thickness of about 3.5 μm by the thermal oxidation method, a photosensitive film was coated on the oxide film. Then the oxide film was patterned by the photolithography process, thereby forming insulation film patterns having line widths of about 1.0 μm and thicknesses of about 1.5 μm on the substrate. When the oxide film was patterned, the BOE solution was used as an etchant widely used in the semiconductor technology.

A platinum thin film having a thickness of approximately 1.0 μm was formed by sputtering platinum on the insulation film patterns and on the photosensitive film. At that time, the processing conditions for forming the platinum thin film were identical to those of the aforementioned embodiment 1. Platinum thin film patterns were formed within the insulation film patterns through removing the photosensitive film with an acetone solution. After a second insulation film was formed on the platinum film patterns and on the insulation film patterns in order to protect a device, a pad region of the metal thin film patterns was partially exposed. Then, the pad region was connected to an external wire, whereby completing the test wafer for compensating temperature.

In general, the majority of the semiconductor manufacturing process proceeds in a predetermined chamber under a vacuum atmosphere or a poisonous gas atmosphere. At that time, properties of the deposited material are closely related to the temperature of the substrate, and a thermosensor should directly contacts with the substrate in order to precisely measure the temperature of the substrate. But the thermosensor does not directly contact with the substrate due to the construction of the equipment used for the semiconductor manufacturing process. However, according to the present invention, the thermosensor directly contacted with the substrate can be manufactured in order to precisely measure the temperature of the substrate. More specifically, the thermosensor of the present invention is buried in the substrate when the temperature of the substrate is compensated with the metal thin film resistor device, thereby precisely measuring the temperature of the substrate on which the deposited materials are positioned.

Embodiment 3

After an oxide film as a first insulation film was formed on a substrate such as a silicon wafer to have a thickness of about 3.5 μm by the thermal oxidation method, a photosensitive film was coated on the oxide film. Then, the oxide film was patterned by the photolithography method, so that insulation film patterns having line widths of about 2 μm and thicknesses of about 1.5 μm. When the oxide film was patterned, a BOE solution was used as an etchant used in the semiconductor technology. A negative or a positive photosensitive film can be used as the photosensitive film in accordance with the process for forming the insulation film patterns.

While the photosensitive film is coated on the insulation film patterns, a platinum thin film having a thickness of about 1.0 μm was formed by sputtering platinum on the photosensitive film and on the insulation film patterns. Preferably, the platinum thin film was deposited using a platinum target having a purity of above 99.995% and a size of about 4 inches at a room temperature under a deposition pressure of about 1~10 mTorr with a deposition power of about 150 W. After the platinum thin film was formed, the platinum thin film was subsequently heated for about 1 hour at a temperature of about 1000° C. Platinum thin film patterns were formed within the insulation film patterns through removing the photosensitive film using a solution including acetone after the platinum thin film was deposited. A ceramic thin film for a sensor was deposited on the platinum thin film patterns, thereby completing a thin film heater with a patterned metal thin film resistor for enhancing a sensibility of the ceramic thin film.

According to the present embodiment, the metal thin film resistor used as the thin film heater can be manufactured, and such thin film heater can be applied in a great variety of ceramic sensor systems.

Embodiment 4

After patterns having line width of about 2 μm and thicknesses of about 1.5 μm were formed on a silicon substrate or a metal substrate, the patterns were heated to form insulation film patterns on the substrate.

A platinum thin film having a thickness of about 1.0 μm was formed by means of sputtering platinum within and on the insulation film patterns. In the present embodiment, the processing conditions for forming the platinum thin film were identical to those of the aforementioned embodiment 1. Portions of the platinum thin film on the insulation film patterns were removed by polishing the surface of the platinum thin film through a chemical mechanical polishing (CMP) method. Thus, platinum thin film patterns were formed within the insulation film patterns. After an insulation film was formed on the platinum film patterns and on the insulation film patterns, a lead wire was attached to a pad region of the platinum thin film patterns and a passivation layer was formed on the lead wire, whereby completing a metal thin film thermosensor or a metal thin film heater.

INDUSTRIAL APPLICABILITY

According to the present invention, the metal thin film patterns are formed by etching the insulation film during the process for manufacturing the metal thin film resistor device, thereby resolving some problems such as the deterioration of the device, the decrease of the durability of the device, and the minimization of the device. Considering the present technology, the metal thin film patterns formed within the insulation film patterns can have line widths of about 0.1 $\mu$m because the insulation film patterns formed on the substrate have widths of about 0.1 $\mu$m and the metal thin film patterns are formed within the insulation film patterns.

Also, because the process of forming the patterns in the insulation film is easily performed to control the line widths and the accurate dimensions of the patterns in comparison with that of forming the patterns in a metal thin film, the resistance of the metal thin film resistor device can be easily controlled when the metal thin film patterns are formed within the insulation film patterns, and a temperature resolution can be enhanced by means of fabricating the thermosensor having a high resistance according as the line widths of the metal thin film patterns are reduced.

Also, a test wafer for compensating temperature according to the present invention can precisely measure a surface temperature of a substrate, so the test wafer can improve the process for depositing the film. The metal thin film resistor device of the present invention can also be used as a thin film heater. Furthermore, the construction of the metal thin film resistor device according to the present invention can be applied to electric devices using the oxide film, and allow the metal thin film resistor device to be manufactured more easily and cheaply since it does not depend on the kind of a substrate nor a deposition process.

Although the preferred embodiments of the invention have been described, it is understood that the present invention should not be limited to these preferred embodiments, but various changes and modifications can be made by one skilled in the art within the spirit and scope of the invention as hereinafter claimed.

What is claimed is:

1. A method for manufacturing a metal thin film resistor comprising the steps of:

forming a first insulation film on an insulation substrate;

forming a photosensitive film on the first insulation film;

patterning the first insulation film using the photosensitive film as a mask to form insulation film patterns;

forming a metal thin film on the photosensitive film and among the insulation film patterns;

forming metal thin film patterns within the insulation film patterns by simultaneously removing the photosensitive film and portions of the metal thin film on the photosensitive film;

forming a second insulation film on the insulation film patterns and the metal thin film patterns;

attaching a lead wire to a pad region of the metal thin film patterns; and forming a passivation layer on the lead wire and on a peripheral portion of the lead wire.

2. The method according to claim 1, wherein the step of forming the first insulation film is performed by a thermal oxidation method.

3. The method according to claim 2, wherein the step of forming the metal thin film is performed by one selected from the group consisting of a DC/RF sputtering method, a metal organic chemical vapor deposition meted, a vacuum evaporation method, a laser ablation method, a partially ionized beam deposition method and an electroplating method.

4. The method according to claim 1, wherein the metal thin film patterns are composed of at least one selected from the group consisting of platinum, nickel, copper, tungsten, tantalum, aluminum, palladium, rhodium, iridium and tantal-aluminum.

5. The method according to claim 1, wherein the first insulation film is formed by a thermal oxidation method or a chemical vapor deposition method.

6. The method according to claim 1, wherein the second insulation film is composed of an amorphous or glass material selected from the group consisting of BSG, PSG, BPSG, $SiO_2$ and $TiO_2$.

* * * * *